US009165503B2

(12) United States Patent
Shih et al.

(10) Patent No.: US 9,165,503 B2
(45) Date of Patent: Oct. 20, 2015

(54) PIXEL STRUCTURE WITH COMPENSATION FUNCTION, AND DRIVING METHOD THEREOF

(71) Applicant: AU Optronics Corporation, Hsin-Chu (TW)

(72) Inventors: Kai-Teng Shih, Hsin-Chu (TW); Chun-Yen Liu, Hsin-Chu (TW); Chia-Yuan Yeh, Hsin-Chu (TW); Chen-Hao Kuo, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 288 days.

(21) Appl. No.: 13/910,292

(22) Filed: Jun. 5, 2013

(65) Prior Publication Data

US 2014/0225878 A1 Aug. 14, 2014

(30) Foreign Application Priority Data

Feb. 8, 2013 (TW) ..... 102105420 A

(51) Int. Cl.
*G09G 3/32* (2006.01)

(52) U.S. Cl.
CPC ..... *G09G 3/3258* (2013.01)

(58) Field of Classification Search
CPC ..... G09G 3/3258
USPC ..... 345/205, 82
See application file for complete search history.

(56) References Cited

U.S. PATENT DOCUMENTS

| | | | | |
|---|---|---|---|---|
| 7,358,533 | B2 * | 4/2008 | Kim | 257/72 |
| 8,519,914 | B2 * | 8/2013 | Kim | 345/76 |
| 2009/0027312 | A1 | 1/2009 | Han et al. | |
| 2011/0141000 | A1 | 6/2011 | Han et al. | |
| 2011/0193855 | A1 | 8/2011 | Han | |
| 2013/0314305 | A1 * | 11/2013 | Liu et al. | 345/77 |
| 2014/0049169 | A1 * | 2/2014 | LI et al. | 315/173 |

FOREIGN PATENT DOCUMENTS

| | | | | |
|---|---|---|---|---|
| CN | 102831859 | | 12/2012 | |
| CN | 102831859 | A * | 12/2012 | G09G 3/32 |
| CN | 102881255 | | 1/2013 | |
| CN | 102881255 | A * | 1/2013 | G09G 3/32 |

* cited by examiner

*Primary Examiner* — Kwang-Su Yang
(74) *Attorney, Agent, or Firm* — WPAT, PC; Justin King

(57) ABSTRACT

A pixel structure and a driving method thereof are disclosed. The pixel structure includes a first capacitor, an input unit, a compensation unit, a pixel driving unit, a resetting unit, a light-emitting diode, a light-emitting activation unit and a coupling unit. The input unit controls a voltage on a first terminal of the first capacitor according to a first scanning signal and a data signal. The compensation unit coupled to the first capacitor is configured to control voltages on the terminals of the first capacitor according to a second scanning signal. The pixel driving unit is configured to provide a driving current to the light-emitting diode according to a first reference voltage and the voltage on a second terminal of the first capacitor. The coupling unit is coupled to the light-emitting activation unit, the first terminal of the first capacitor, the input unit and the compensation unit.

20 Claims, 7 Drawing Sheets

PIXEL STRUCTURE WITH COMPENSATION FUNCTION, AND DRIVING METHOD THEREOF

RELATED APPLICATIONS

This application claims priority to Taiwan Application Serial Number 102105420, filed Feb. 8, 2013, which is herein incorporated by reference.

BACKGROUND

1. Field of Invention

The disclosure relates to an organic light-emitting display device. More particularly, the disclosure relates to a pixel structure of the organic light-emitting display device.

2. Description of Related Art

Among various types of digital display devices, the active matrix organic light emitting display (AMOLED) device is highly competitive in a digital display device market, since the AMOLED device has advantages such as self-light-emitting, high luminance, high light-emitting efficiency, high contrast, rapid reaction speed, wide visual angle and large available temperature range.

A conventional AMOLED device includes a gate driving circuit (i.e., scan-line driving circuit), a data driving circuit and a plurality of pixel units. Each of the pixel units in the conventional AMOLED device includes an input transistor, a driving transistor, a storing capacitor and a light-emitting diode.

The gate driving circuit and the data driving circuit are respectively utilized for proving a scanning signal and a data signal to the input transistor in each of the pixel units. According to the scanning signal and the data signal, each of the pixel units controls a driving current generated by the driving transistor, such as to drive the light-emitting diode (LED) and generate lights.

However, while the AMOLED device is operating, the driving current over the light-emitting diode is affected by a threshold voltage of the driving transistor. In addition, there is a certain difference (or mismatch) existed between the threshold voltages on the driving transistors of different pixel units, and the difference of threshold voltages between different pixel units may lead to a luminance distortion between pixel units, and further to decrease the display quality of the AMOLED device.

SUMMARY

An aspect of the disclosure provides a pixel structure, which includes a first capacitor, a second capacitor, a first transistor, a second transistor, a third transistor, a fourth transistor, a fifth transistor, a sixth transistor and a light-emitting diode. The first capacitor has a first terminal and a second terminal. The first transistor has a first terminal for receiving a data signal, a gate terminal for receiving a first scanning signal, and a second terminal electrically coupled to the first terminal of the first capacitor. The second transistor has a first terminal for receiving a first reference voltage, a gate terminal electrically coupled to the second terminal of the first capacitor, and a second terminal for outputting a driving current. The third transistor has a first terminal electrically coupled to the second terminal of the second transistor, a gate terminal for receiving a second scanning signal, and a second terminal electrically coupled to the second terminal of the first capacitor and the gate terminal of the second transistor. The fourth transistor has a first terminal electrically coupled to the gate terminal of the second transistor, the second terminal of the third transistor and the second terminal of the first capacitor, a gate terminal for receiving a third scanning signal, and a second terminal for receiving a second reference voltage. The fifth transistor has a first terminal for receiving the first reference voltage, a gate terminal for receiving the second scanning signal, and a second terminal electrically coupled to the first transistor and the first capacitor. The sixth transistor has a first terminal electrically coupled to the second terminal of the second transistor, a gate terminal for receiving a light-emitting signal, and a second terminal electrically coupled to the light-emitting diode. The light-emitting diode has a first terminal electrically coupled to the second terminal of the sixth transistor, and a second terminal for receiving a third reference voltage. The second capacitor has a first terminal electrically coupled to the first terminal of the first capacitor, the second terminal of the fifth transistor and the second terminal of the first transistor, and a second terminal for receiving the light-emitting signal.

Another aspect of the disclosure provides a pixel structure, which includes a first capacitor, an input unit, a compensation unit, a pixel driving unit, a resetting unit, a light-emitting diode, a light-emitting activation unit and a coupling unit. The first capacitor has a first terminal and a second terminal. The input unit is configured to control a voltage on the first terminal of the first capacitor according to a first scanning signal and a data signal. The compensation unit electrically coupled to the first capacitor is configured to control voltages on the terminals of the first capacitor according to a second scanning signal. The pixel driving unit is configured to provide a driving current according to a first reference voltage and the voltage on the second terminal of the first capacitor. The resetting unit electrically coupled to the pixel driving unit is configured to reset the voltage on the second terminal of the first capacitor according to a third scanning signal and a second reference voltage. The light-emitting diode is configured to receive a third reference voltage and the driving current. The light-emitting activation unit electrically coupled between the light-emitting diode and the pixel driving unit is configured to provid the driving current to the light-emitting diode according to the light-emitting signal. The coupling unit is electrically coupled to the light-emitting activation unit, the first terminal of the first capacitor, the input unit and the compensation unit.

Another aspect of the disclosure provides a driving method of a pixel structure. As the aforesaid pixel structure, the driving method includes: in a first period, driving the resetting unit through the third scanning signal to reset the voltage on the second terminal of the first capacitor through the second reference voltage; in a second period after the first period, driving the compensation unit through the second scanning signal to control the voltage on the first terminal of the first capacitor through the first reference voltage, and driving the compensation unit through the second scanning signal to control the voltage on the second terminal of the first capacitor through the first reference voltage to perform a threshold voltage compensation operation for the pixel driving unit; in a third period after the second period, controlling the voltage on the first terminal of the first capacitor through the data signal to control the voltage on the second terminal of the first capacitor by coupling through the first capacitor, and driving the pixel driving unit through the voltage on the second terminal of the first capacitor to provide the driving current through the first reference voltage; and in a fourth period after the third period, stabilizing the voltage on the first terminal of the first capacitor and avoiding a floating voltage, driving the light-emitting activation unit through the light-emitting signal to feed the driving current into the light-emitting diode.

DETAILED DESCRIPTION

Figure 1:
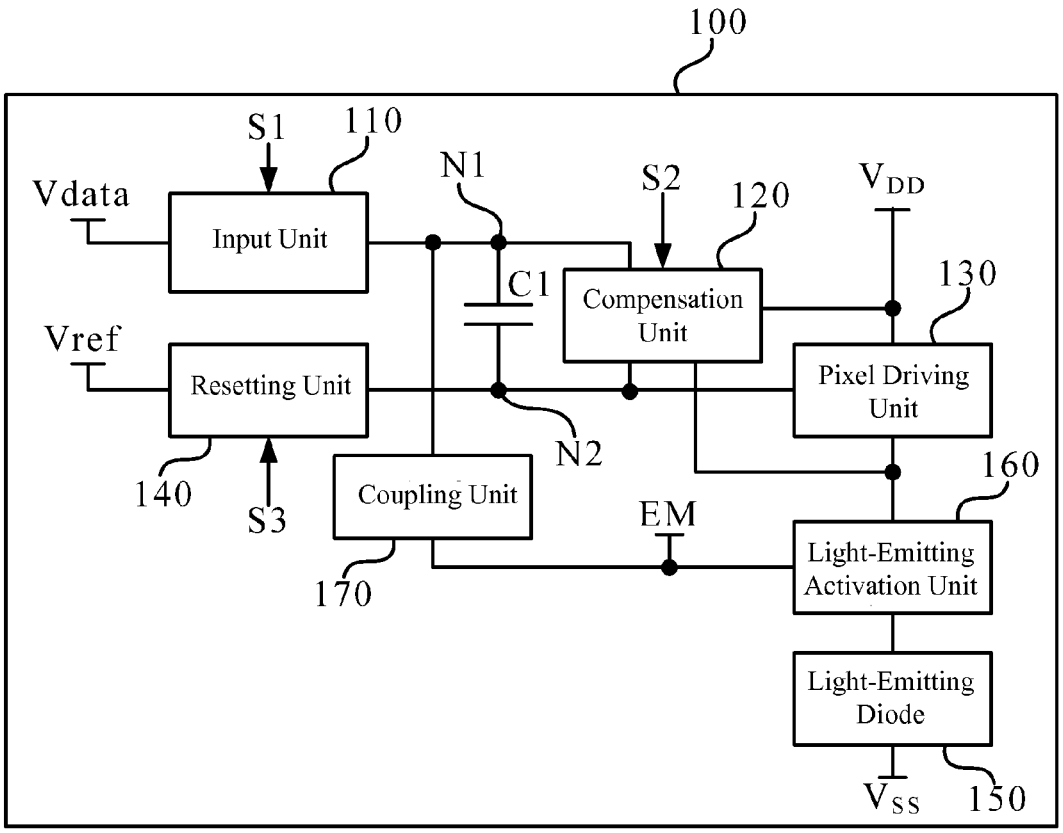
FIG. 1 is a schematic diagram illustrating a pixel structure of a display device according to an embodiment of the disclosure.

A plurality of embodiments of the disclosure will be disclosed below with reference to drawings. For purpose of specification, many details in practice will be described together with the following description. However, it should be understood that these details in practice are not used to limit the disclosure. In some embodiments of the disclosure, these details in practice are unnecessary. Additionally, for purpose of simplifying drawings, some conventional structures and elements in the drawings will be shown in a simple way.

In order to solve a problem of threshold voltage difference between different pixel units, some conventional pixel units further have a threshold voltage compensation circuit for compensating the threshold voltage on the driving transistor. A traditional threshold voltage compensation circuit is started during the period that the scanning signal corresponding to the pixel unit is enabled, and the threshold voltage compensation operation is carried out during a writing period of the data signal. Therefore, the total length of compensation time of the threshold voltage is limited by the activation duration corresponding to a single pixel unit (the activation duration is usually the time duration per pulse). In general, the traditional threshold voltage compensation circuit substantially requires 10 microseconds (μs) for the threshold voltage compensation, so as to complete its function correctly. However, the activation duration length is quite short on a panel with a high resolution and high refresh frequency. Typically, the activation durations under various resolutions are shown in Table 1 as follow:

TABLE 1

| Resolution | Refresh Frequency 60 Hz | Refresh Frequency 120 Hz |
|---|---|---|
| nHD | 21 μs | 9.5 μs |
| WVGA | 17 μs | 7.7 μs |
| DVGA | 14 μs | 6.3 μs |
| Full HD | 12 μs | 5.7 μs |

It can be seen from the above table that, when the resolution and refresh frequency of a display device is increased, the time for compensating the threshold voltages may be insufficient (the threshold voltage compensation may take 10 μs to assure the effect in some cases) on the traditional threshold voltage compensation circuit.

Reference is made to FIG. 1, which is a schematic diagram illustrating a pixel structure 100 of a display device according to an embodiment of the disclosure. In a practical application, the pixel structure 100 in the embodiment may be applied in an AMOLED device. The display device may include a plurality of pixel structures 100 as shown in FIG. 1 for constituting a whole display panel.

As shown in FIG. 1, each of the pixel structures 100 includes a first capacitor C1, an input unit 110, a compensation unit 120, a pixel driving unit 130, a resetting unit 140, a light-emitting diode 150, a light-emitting activation unit 160 and a coupling unit 170.

The first capacitor C1 has a first terminal N1 and a second terminal N2. In the practical application, the first capacitor C1 may be used as a pixel storing capacitor in the pixel structure 100 for storing a control voltage of the pixel driving unit 130.

The input unit 110 is configured to control the voltage on the first terminal N1 of the first capacitor C1 according to a first scanning signal S1 and a data signal Vdata. For example, when the first scanning signal S1 is enabled, the input unit 110 inputs the data signal Vdata to the first terminal N1 of the first capacitor C1.

The pixel driving unit 130 is configured to provid a driving current Id according to the first reference voltage and the voltage on the second terminal N2 of the first capacitor C1. In this embodiment, the first reference voltage may be a system high voltage $V_{DD}$, but is not limited to this. The compensation unit 120 electrically coupled to the first capacitor C1 is configured to control the voltages on the terminals (the first terminal N1 and the second terminal N2) of the first capacitor C1 according to a second scanning signal S2. For example, when the second scanning signal S2 is enabled, the compensation unit 120 may adjust the voltages on the terminals of the first capacitor C1 to compensate the threshold voltage of the pixel driving unit 130.

The resetting unit 140 electrically coupled to the pixel driving unit 130 is configured to reset the voltage on the second terminal N2 of the first capacitor C1 according to a third scanning signal S3 and the second reference voltage. In this embodiment, the second reference voltage may be a base voltage Vref with a particular level, but is not limited to this.

The light-emitting diode 150 is configured to receive the third reference voltage and the driving current Id. In this embodiment, the third reference voltage may be a system low voltage VSS, but is not limited to this.

The light-emitting activation unit 160 is electrically coupled between the light-emitting diode 150 and the pixel driving unit 130. The light-emitting activation unit 160 is configured to provid the driving current Id to the light-emitting diode 150 according to a light-emitting signal EM.

The coupling unit 170 is electrically coupled to the light-emitting activation unit 160, the first terminal N1 of the first capacitor C1, the input unit 110 and the compensation unit 120.

The coupling unit 170 is configured to avoiding a floating voltage on the first terminal N1 of the first capacitor C1. The coupling unit 170 is further utilized for excluding interference of a parasitic capacitance parasitized between electronic elements on the first terminal N1 of the first capacitor C1. Additionally, when the light-emitting signal EM is converted from a high level to a low level, a voltage level on the first terminal N1 of the first capacitor C1 may be pulled down through a coupling effect of the coupling unit 170, assuring that the data signal Vdata may be written in correctly.

Figure 2:
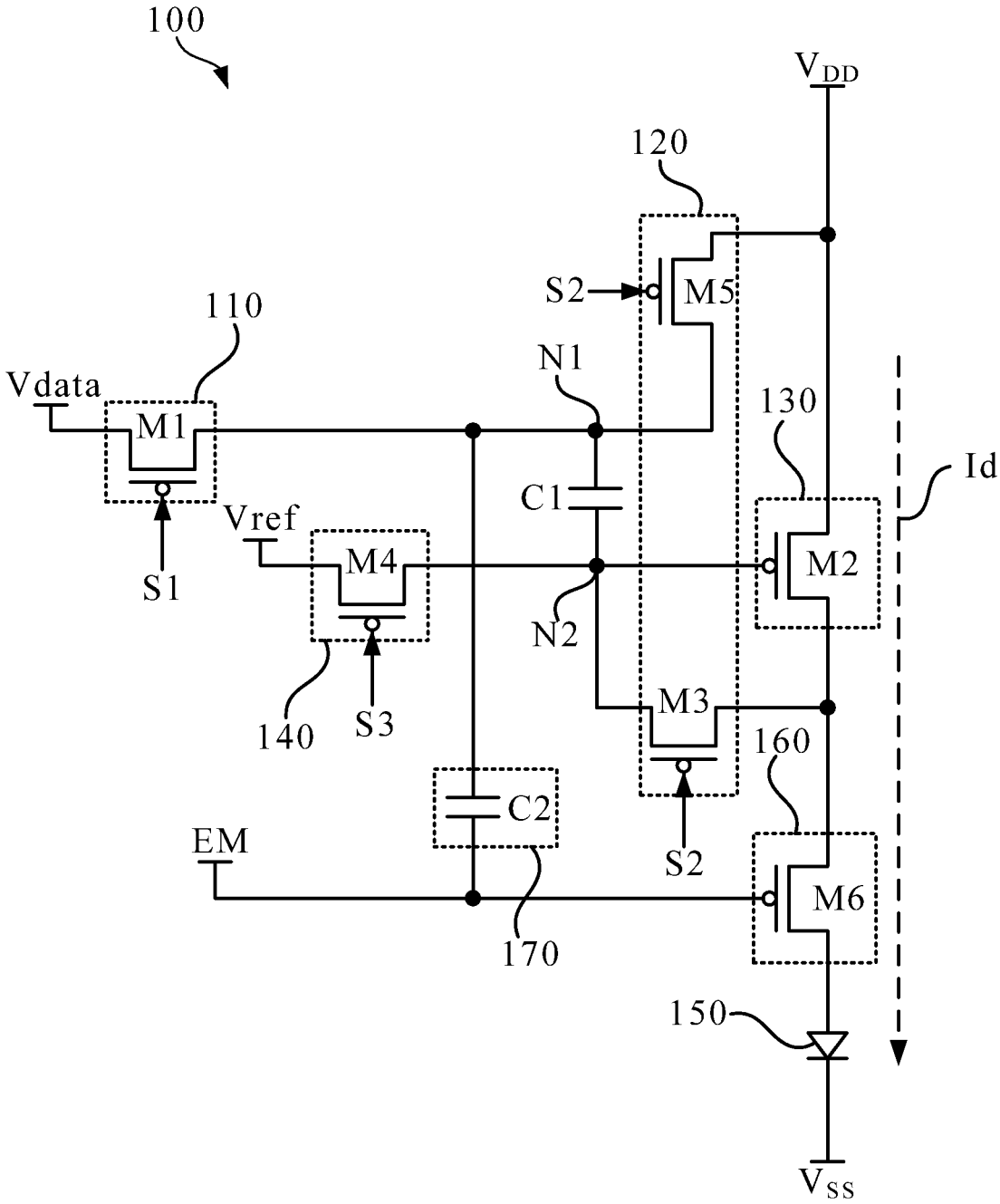
FIG. 2 is a schematic diagram illustrating circuits of the pixel structure according to an embodiment of the disclosure.

Reference is also made to FIG. 2, which is a schematic diagram illustrating circuits of the pixel structure 100 according to an embodiment of the disclosure.

As shown in the embodiment of FIG. 2, the input unit 110 includes a first transistor M1. The first terminal of the first transistor M1 is configured to receive the data signal Vdata. The gate terminal of the first transistor M1 is configured to receive the first scanning signal S1. The second terminal of the first transistor M1 is electrically coupled to the compensation unit 120, the first terminal N1 of the first capacitor C1 and the coupling unit 170. The first transistor M1 controls the voltage on the first terminal N1 of the first capacitor C1 according to the first scanning signal S1 and the data signal Vdata.

The pixel driving unit 130 includes a second transistor M2 and is configured to provid the driving current Id according to the first reference voltage and the voltage on the second terminal N2 of the first capacitor C1. The first terminal of the second transistor M2 is configured to receive the first reference voltage (i.e., the system high voltage $V_{DD}$). The gate terminal of the second transistor M2 is electrically coupled to the second terminal N2 of the first capacitor C1. The second terminal of the second transistor M2 is configured to outputting the driving current Id. A magnitude of the driving current Id is determined based on a conducting state of the second transistor M2. In general, a current magnitude of the driving current (Id) may be known from the following formula (1):

$$Id = \frac{1}{2}\mu C\frac{W}{L}(Vsg_2 - |Vth_2|)^2; \qquad \text{Formula (1)}$$

In Formula (1), $Vsg_2$ is a voltage difference between a source and a gate of the second transistor M2 in the pixel driving unit 130, $Vth_2$ is the threshold voltage of the second transistor M2, W represents the width of a channel of the to second transistor M2, L represents the length of the channel of the second transistor M2, C represents capacitance on the gate of the second transistor M2, and μ represents the equivalent carrier mobility.

As shown in the embodiment of FIG. 2, the compensation unit 120 includes a third transistor M2 and a fifth transistor M5 and is configured to control the voltage on the terminals (the first terminal N1 and the second terminal N2) of the first capacitor C1 according to the second scanning signal S2. The first terminal of the third transistor M3 is electrically coupled to the pixel driving unit 130 (the second terminal of the second transistor M2) and the light-emitting activation unit 160. The gate terminal of the third transistor M3 is configured to receive the second scanning signal S2. The second terminal of the third transistor M3 is electrically coupled to the first capacitor C1 and the pixel driving unit 130 (the gate terminal of the second transistor M2).

The first terminal of the fifth transistor M5 is configured to receive the first reference voltage (i.e., the system high voltage VDD). The gate terminal of the fifth transistor M5 is configured to receive the second scanning signal S2. The second terminal of the fifth transistor M5 is electrically coupled to the input unit 110 (the second terminal of the first transistor M1), the first capacitor C1 and the coupling unit 170. For example, when the second scanning signal S2 is enabled, the third transistor M3 and the fifth transistor M5 in the compensation unit 120 are conducted and respectively utilized for controlling the voltages on the terminals of the first capacitor C1, so as to compensate the threshold voltage of the pixel driving unit 130. The detailed compensation operation and methods will be further described in detail in the follow-up paragraphs.

As shown in the embodiment of FIG. 2, the resetting unit 140 includes a fourth transistor M4. The first terminal of the fourth transistor M4 is electrically coupled to the pixel driving unit 130 (the gate terminal of the second transistor M2), the first capacitor C1 (the second terminal N2 of the first capacitor C1) and the compensation unit 120 (the second terminal of the third transistor M3). The gate terminal of the fourth transistor M4 is configured to receive the third scanning signal S3. The second terminal of the fourth transistor M4 is configured to receive the second reference voltage (i.e., the base voltage Vref). For example, when the third scanning signal S3 is enabled, the fourth transistor M4 is conducted, and the voltage (i.e., the voltage on the gate terminal of the second transistor M2) on the second terminal N2 of the first capacitor C1 is reset to the base voltage Vref.

As shown in the embodiment of FIG. 2, the light-emitting activation unit 160 includes a sixth transistor M6 and is configured to selectively provide the driving current Id to the light-emitting diode 150 according to the light-emitting signal EM. The first terminal of the sixth transistor M6 is electrically coupled to the pixel driving unit 130 (the second terminal of the second transistor M2). The gate terminal of the sixth transistor M6 is configured to receive the light-emitting signal EM. The second terminal of the sixth transistor M6 is electrically coupled to the light-emitting diode 150.

As shown in the embodiment of FIG. 2, the coupling unit 170 includes the second capacitor C2. The first terminal of the second capacitor C2 is electrically coupled to the first terminal N1 of the first capacitor C1, the compensation unit 120 (the second terminal of the fifth transistor M5) and the input unit 110 (the second terminal of the first transistor M1). The second terminal of the second capacitor C2 is configured to receive the light-emitting signal EM.

The second capacitor C2 of the coupling unit 170 is further configured to avoid the floating voltage on the first terminal N1 of the first capacitor C1. The second capacitor C2 is further utilized for excluding the interference of the parasitic capacitance parasitized between the electronic elements on the first terminal N1 of the first capacitor C1.

In addition, the terminals of the second capacitor C2 are coupled between the first terminal N1 of the first capacitor C1 and the light-emitting signal EM. When the light-emitting signal EM is converted from the high level to the low level, the voltage level on the first terminal N1 of the first capacitor C1 may be pulled down by coupling the second capacitor C2 of the coupling unit 170, assuring that the data signal Vdata may be written in correctly.

Figure 3:
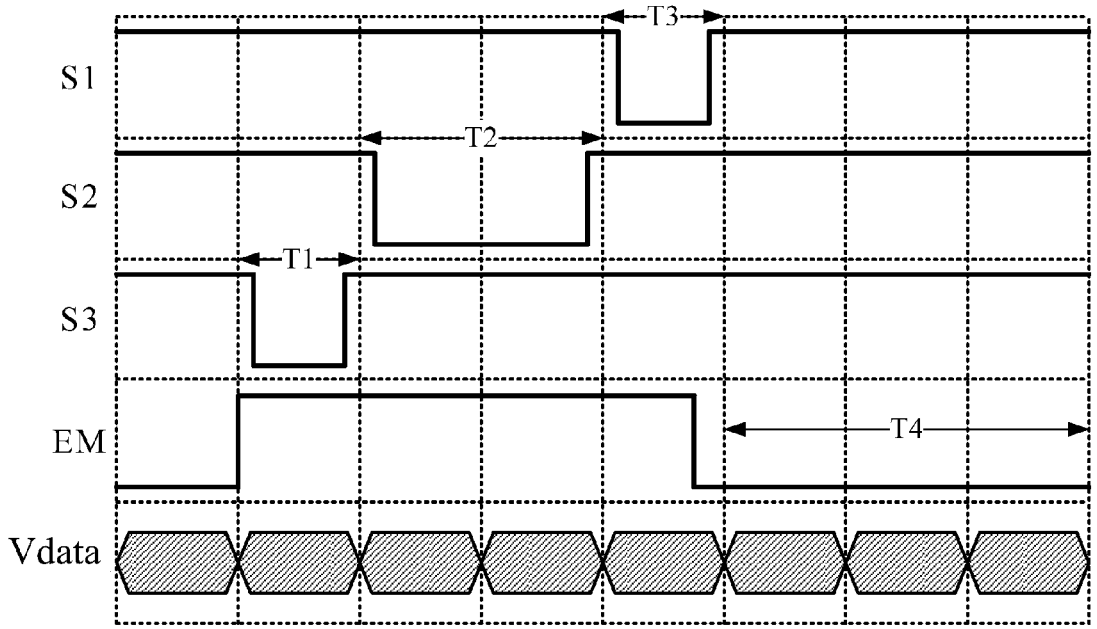
FIG. 3 is a schematic diagram illustrating signals of the pixel structure in an operative embodiment of the driving method.

A driving method of the pixel structure is further provided in the disclosure for driving the pixel structure 100 as shown in FIGS. 1 and 2. Reference is also made to FIG. 3, which is a schematic diagram illustrating signals of the pixel structure 100 in an operative embodiment of the driving method.

As shown in FIGS. 2 and 3, in a first period T1, the driving method is utilized for providing the first scanning signal S1 with a first level to the input unit 110, providing the second scanning signal S2 with the first level to the compensation unit 120, providing the third scanning signal S3 with a second level to the resetting unit 140 and providing the light-emitting signal EM with the first level.

The second level is different from the first level. In this embodiment, the second level represents the voltage level at an activation state, and the first level represents the voltage level at an off state. In the embodiment of FIG. 2, the first to sixth transistors M1-M6 are exemplified as low enable transistors. Correspondingly, as shown in the embodiment of FIG. 3, the first level is the high level and the second level is the low level, but the disclosure is not limited to this. Alternatively, it is well-known for those of skills in the art that high enable transistors may also be used, and definitions of the first and second levels may be adjusted correspondingly.

Figure 4:
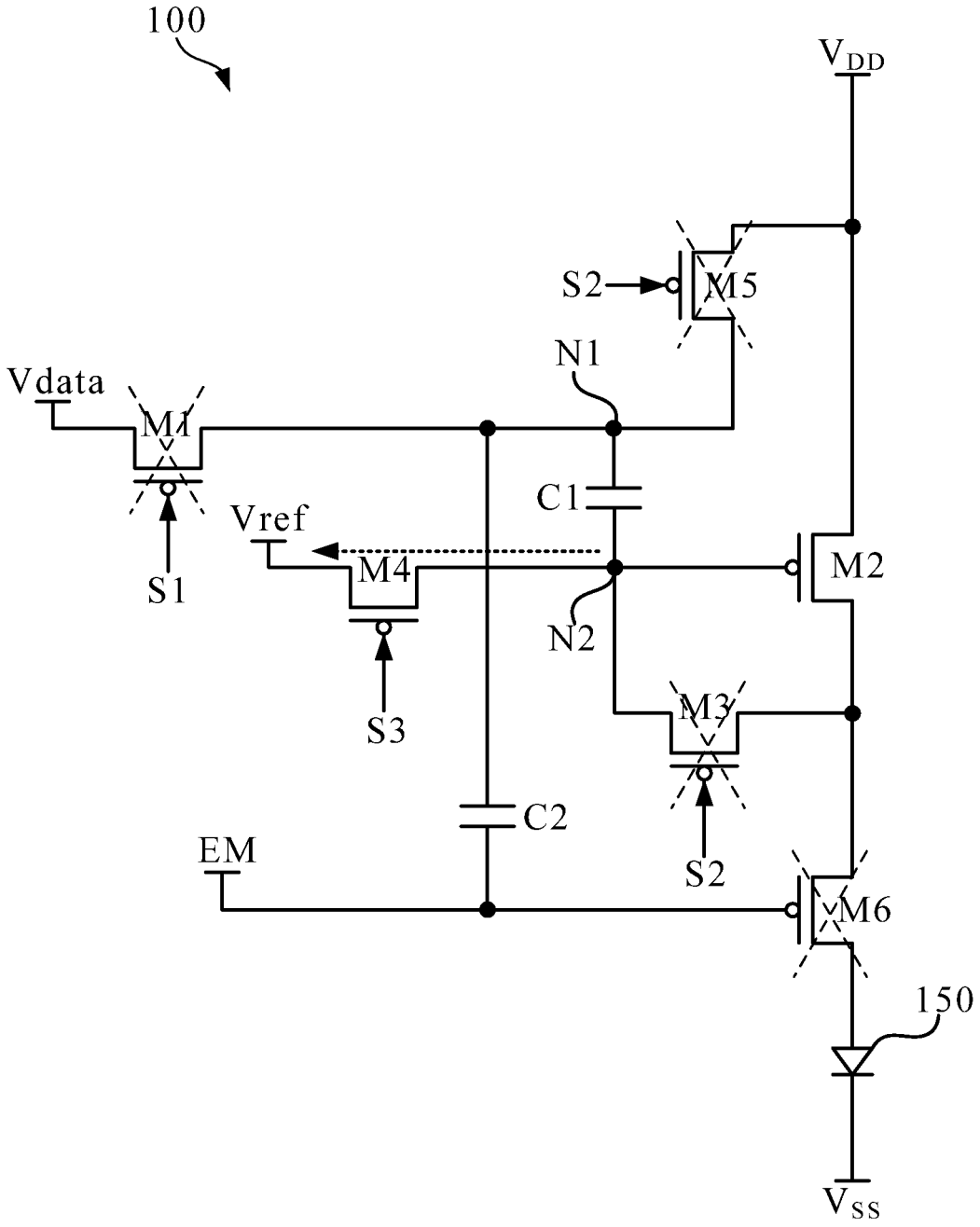
FIG. 4 is a schematic diagram illustrating states of the transistors in the pixel structure of FIG. 2 in the first period.

Reference is also made to FIG. 4, which is a schematic diagram illustrating states of the transistors in the pixel structure 100 of FIG. 2 in the first period T1.

In the first period T1, the fourth transistor M4 in the resetting unit 140 is driven to be turned on through the third scanning signal S3 (at the second level representing the activation state), and then the voltage on the second terminal N2 of the first capacitor C1 is reset through the second reference voltage (Vref).

In the first period T1, the first transistor M1, the third transistor M3, the fifth transistor M5 and the sixth transistor M6 are not conducted. In this embodiment, the first period T1 corresponds to a resetting period of the pixel structure 100.

As shown in FIGS. 2 and 3, in a second period T2 after the first period T1, with the driving method, the third scanning signal S3 has been switched from the second level to the first level, so as to turn off the fourth transistor M4 to disable a resetting operation of the resetting unit 140.

In addition, with the driving method, the second scanning signal S2 is switched from the first level to the second level, so as to drive the third transistor M3 and the fifth transistor M5 in the compensation unit 120 through the second scanning signal S2 to be turned on.

Figure 5:
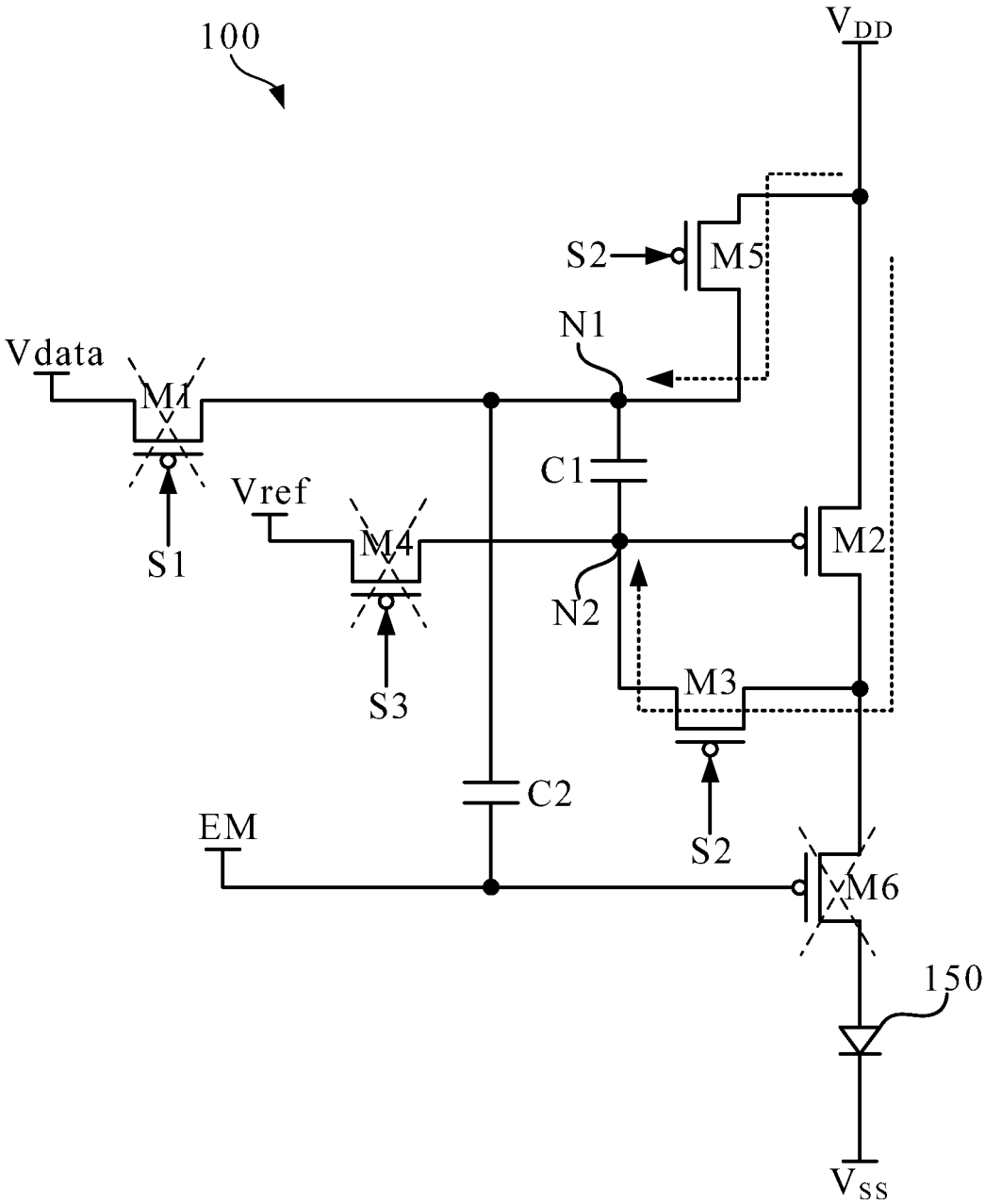
FIG. 5 is a schematic diagram illustrating states of the transistors in the pixel structure of FIG. 2 in the second period.

Reference is also made to FIG. 5, which is a schematic diagram illustrating states of the transistors in the pixel structure 100 of FIG. 2 in the second period T2.

In the second period T2, because the fifth transistor M5 is turned on, the voltage on the first terminal N1 of the first capacitor C1 is controlled through the first reference voltage (i.e., the system high voltage $V_{DD}$). In other words, the voltage on the first terminal N1 at this time is approximate to $V_{DD}$.

In addition, because the third transistor M3 is turned on, the voltage (i.e., a gate voltage of the second transistor M2) on the second terminal N2 of the first capacitor C1 is controlled through the output voltage (i.e., the voltage on the second terminal of the second transistor M2) of the pixel driving circuit 130, so as to perform the threshold voltage compensation operation for the second transistor M2 of the pixel driving unit 130. As the fifth transistor M5 is turned on, after the gate voltage of the second transistor M2 is compensated and reaches stable (the gate of the second transistor M2 is charged through the system high voltage $V_{DD}$ until the second transistor M2 is just turned on), the gate voltage (the voltage on the second terminal N2) of the second transistor M2 is approximate to $V_{DD}-|Vth_2|$. In other words, the voltages on the terminals of the first capacitor C1 are approximate to $Vth_2$, wherein $Vth_2$ is the threshold voltage of the second transistor M2. In this embodiment, the second period T2 corresponds to a compensation period of the pixel structure 100.

In the second period T2, the first transistor M1, the fourth transistor M4 and the sixth transistor M6 are not turned on. It should be supplemented that, an action in the second period T2 is controlled by the independent second scanning signal S2, for which a time length is not limited to one separate line scanning time (a reference may be made to a data signal Vdata shown in FIG. 3, each section on a time axis is the time of one line of pixels for writing the data signal in FIG. 3), and also not limited to pulse lengths of other actions (such as the resetting, data writing, light-emitting activation). Duration of the second period T2 may be for example N times of a single line scanning time, wherein N is a positive integer more than 2. For example, in the embodiment of FIG. 3, the duration of the second period T2 may be double of the single line scanning time. As a result, the pixel structure 100 may be assured to have sufficient time to achieve the threshold voltage compensation operation. In other words, the gate voltage (the voltage on the second terminal N2) of the second transistor M2 may be allowed to have sufficient time to convert, so as to compensate the threshold voltage Vth of the transistor M2.

As shown in FIGS. 2 and 3, in a third period T3 after the second period T2, with the driving method, the second scanning signal S2 has been switched from the second level to the first level to disable the threshold voltage compensation operation of the compensation unit 120 and the first scanning signal S1 is switched from the first level to the second level.

Figure 6:
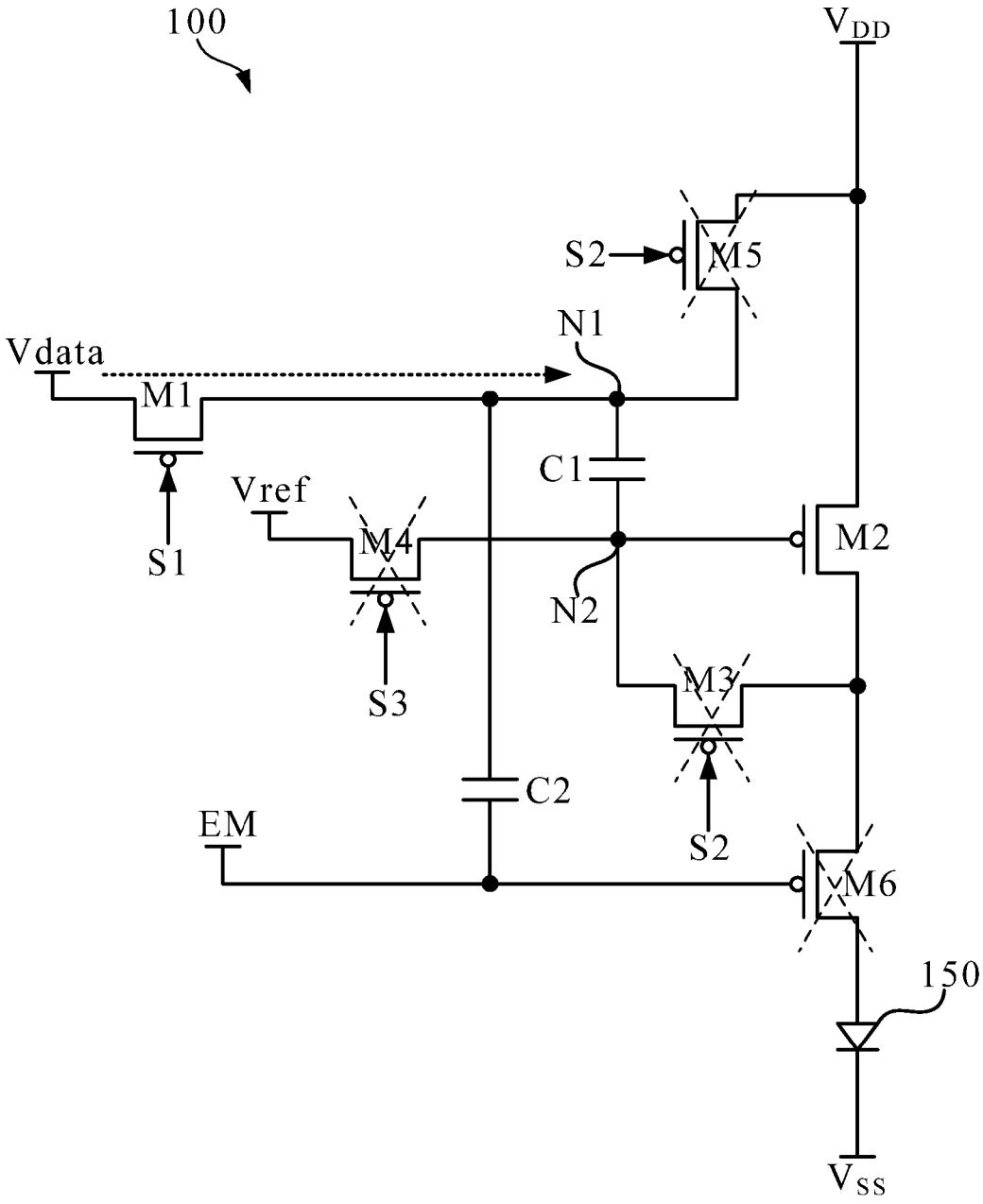
FIG. 6 is a schematic diagram illustrating states of the transistors in the pixel structure of FIG. 2 in the third period.

Referring to FIG. 6, it shows is a schematic diagram illustrating states of the transistors in the pixel structure 100 of FIG. 2 in the third period T3. In this embodiment, the third period T3 corresponds to a data writing period of the pixel structure 100.

In the third period T3, since the first transistor M1 of the input unit 110 is turned on by the first scanning signal S1, the voltage on the first terminal N1 of the first capacitor C1 is controlled by the driving method through the data signal Vdata, and the voltage on the first terminal N1 is changed from $V_{DD}$ to Vdata.

By coupling of the first capacitor C1, the voltage on the second terminal N2 of the first capacitor C1 is controlled to convert into $Vdata-|Vth_2|$. The gate terminal of the second transistor M2 of the pixel driving unit 130 is driven through the voltage on the second terminal N2 of the first capacitor C1, so that the driving current Id is provided by the second transistor M2 through the first reference voltage (i.e., $V_{DD}$).

In the third period T3, the third transistor M3, the fourth transistor M4, the fifth transistor M5 and the sixth transistor M6 are not turned on.

Additionally, as shown in FIG. 3, before a fourth period T4 arrives (i.e., before the first scanning signal S1 is increased to the high level), the light-emitting signal EM is decreased in advance to the low level. It may avoid an undesirable situation that the light-emitting signal EM is decreased to the low level after the first scanning signal S1 has been increased to the high level (the first switch M1 is closed). In the aforesaid undesirable situation, the voltage level on the first terminal N1 of the first capacitor C1 may be pulled too low, so that the threshold voltage compensation of the second transistor M2 is distorted.

Therefore, before the first scanning signal S1 is increased to the high level (the first switch M1 is closed), the light-emitting signal EM is triggered in advance, and may be coupled by the first scanning signal S1, assuring that the threshold voltage of the second transistor M2 is compensated correctly. It would be assured in this process that, before the light-emitting signal EM is triggered in advance, a starting time of the first scanning signal S1 is sufficient to achieve the writing of the data signal Vdata.

Figure 7:
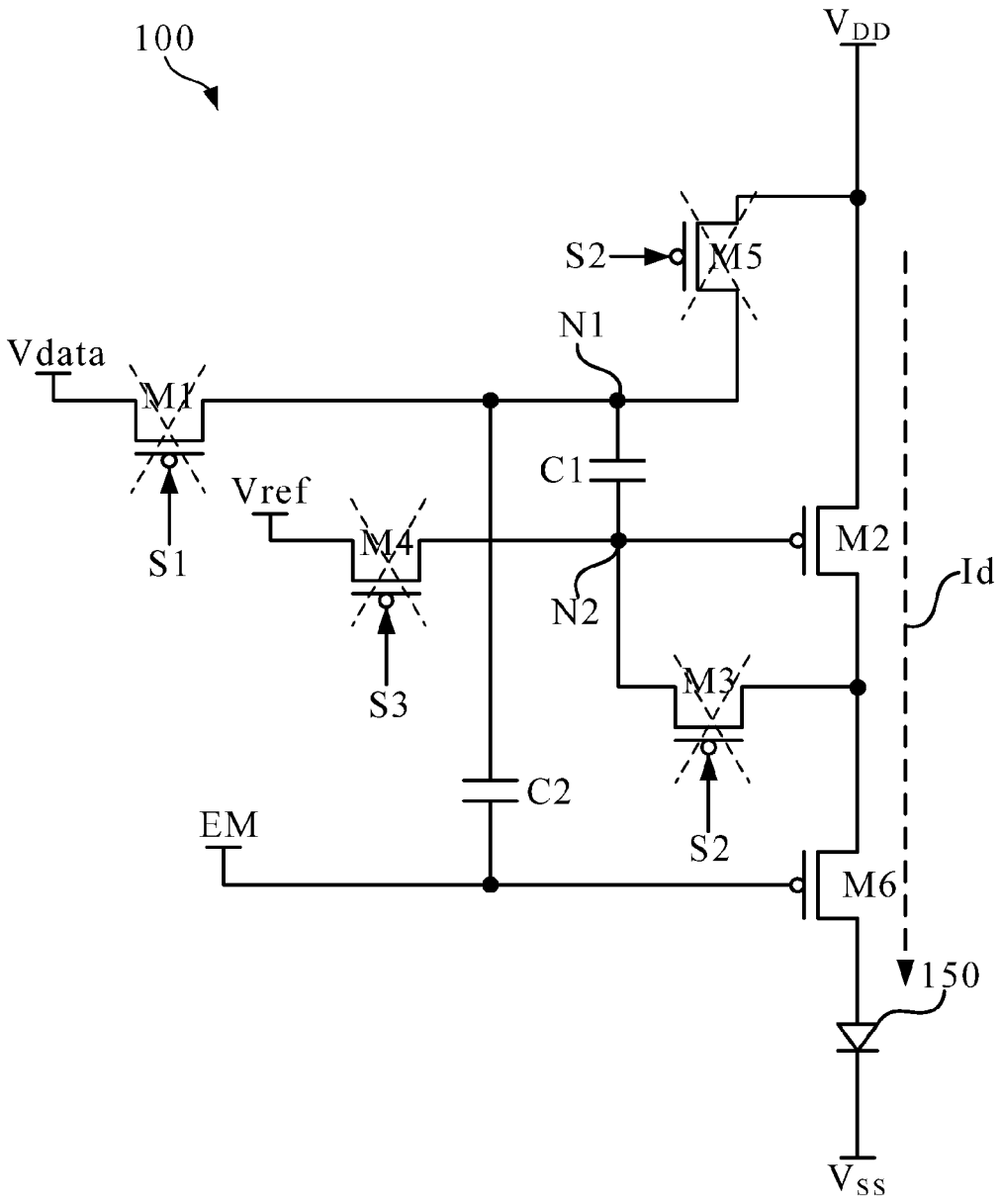
FIG. 7 is a schematic diagram illustrating states of the transistors in the pixel structure of FIG. 2 in the fourth period.

As shown in FIGS. 2 and 3, in the fourth period T4 after the third period T3, with the driving method, the light-emitting signal EM is set as the second level, and the first scanning signal S1 has been switched from the second level to the first level to disable an input operation of the input unit 110. Referring to FIG. 7, which is a schematic diagram illustrating states of the transistors in the pixel structure 100 of FIG. 2 in the fourth period T4. In this embodiment, the fourth period T4 corresponds to a light-emitting period of the pixel structure 100.

In the fourth period T4, the light-emitting signal EM of the second level is configured to drive the sixth transistor M6 in the light-emitting activation unit 160 to be turned on, so as to feed the driving current Id into the light-emitting diode 150.

In the fourth period T4, the first transistor M1, the third transistor M3, the fourth transistor M4 and the fifth transistor M5 are not turned on.

In the practical application, the fourth period T4 (i.e., the light-emitting period of the light-emitting diode 150) will last a particular time. During this period, both of two transistors (the first transistor M1 and the fifth transistor M5) coupled with the first terminal N1 of the first capacitor C1 are not turned on.

If the first terminal N1 of the first capacitor C1 is floating, it is possible to generate a voltage drift, so as to affect the magnitude of the voltage on the second terminal N2 and the magnitude of the driving current Id generated by the second transistor M2. One terminal of the second capacitor C2 in the coupling unit 170 is configured to receive the light-emitting signal EM and a certain voltage difference is maintained on the terminals, which may be used for avoiding the floating voltage on the first terminal N1 of the first capacitor C1, so that the voltage on the first terminal N1 may be roughly maintained at $Vdata-|Vth_2|$.

When the light-emitting signal EM is converted from the high level to the low level, the voltage level on the first terminal N1 of the first capacitor C1 may be pulled down through the coupling effect of the second capacitor C2 in the coupling unit 170, assuring that the data signal Vdata may be written in correctly.

The coupling unit 170 may be further utilized for excluding the interference of the parasitic capacitance parasitized between the electronic elements on the first terminal N1 of the first capacitor C1.

At this time, the voltage difference between the source and the gate of the second transistor M2 is $$Vsg_2=V_{DD}-(Vdata-|Vth_2|).$$

In the fourth period T4, the current magnitude of the driving current Id may be known from the formula (2):

$$Id=\frac{1}{2}\mu C\frac{W}{L}(Vsg_2-|Vth_2|)^2 \quad \text{Formula (2)}$$

$$\Rightarrow Id=\frac{1}{2}\mu C\frac{W}{L}\{[V_{DD}-(Vdata-|Vth_2|)]-|Vth_2|\}^2$$

$$\Rightarrow Id=\frac{1}{2}\mu C\frac{W}{L}(V_{DD}-Vdata)^2.$$

In an ideal case based on the pixel structure 100 and the driving method of the embodiment, the current magnitude of the driving current Id in the light-emitting period is not affected by characteristics of the driving transistor (such as different threshold voltages existed on the driving transistor). The to pixel structure 100 may provide a relatively stable driving current.

In view of the above, embodiments of the disclosure provide a kind of pixel structure having the threshold voltage compensation mechanism. The compensation time of the threshold voltage may be adjustable and not limited by the length (i.e., the time of one line of pixels for writing the data signal) of the single line scanning time. Additionally, during the light-emitting period of the light-emitting diode, the voltage of the pixel capacitor is further stabilized and the floating voltage is avoided, so as to increase the stability.

Although the disclosure has been disclosed with reference to the embodiments, these embodiments are not intended to limit the disclosure. It will be apparent to those of skills in the art that various modifications and variations can be made without departing from the spirit and scope of the disclosure. Therefore, the scope of the disclosure should be defined by the appended claims.

What is claimed is:

1. A pixel structure, comprising:

a first capacitor having a first terminal and a second terminal;

a first transistor, wherein the first transistor has a first terminal for receiving a data signal, a gate terminal for receiving a first scanning signal, and a second terminal electrically coupled to the first terminal of the first capacitor;

a second transistor, wherein the second transistor has a first terminal for receiving a first reference voltage, a gate terminal electrically coupled to the second terminal of the first capacitor, and a second terminal for outputting a driving current;

a third transistor, wherein the third transistor has a first terminal electrically coupled to the second terminal of the second transistor, a gate terminal for receiving a second scanning signal, and a second terminal electrically coupled to the second terminal of the first capacitor and the gate terminal of the second transistor;

a fourth transistor, wherein the fourth transistor has a first terminal electrically coupled to the gate terminal of the second transistor, the second terminal of the third transistor and the second terminal of the first capacitor, a gate terminal for receiving a third scanning signal, and a second terminal for receiving a second reference voltage;

a fifth transistor, wherein the fifth transistor has a first terminal for receiving the first reference voltage, a gate terminal for receiving the second scanning signal, and a second terminal electrically coupled to the first transistor and the first capacitor;

a sixth transistor, wherein the sixth transistor has a first terminal electrically coupled to the second terminal of the second transistor, a gate terminal for receiving a light-emitting signal, and a second terminal;

a light-emitting diode, wherein the light-emitting diode has a first terminal electrically coupled to the second terminal of the sixth transistor, and a second terminal for receiving a third reference voltage; and a second capacitor, wherein the second capacitor has a first terminal electrically coupled to the first terminal of the first capacitor, the second terminal of the fifth transistor and the second terminal of the first transistor, and a second terminal for receiving the light-emitting signal.

2. A pixel structure, comprising:

a first capacitor having a first terminal and a second terminal;

an input unit, wherein the input unit is configured to control a voltage on the first terminal of the first capacitor according to a first scanning signal and a data signal;

a compensation unit electrically coupled to the first capacitor, wherein the compensation unit is configured to control the voltage on the terminals of the first capacitor according to a second scanning signal;

a pixel driving unit electrically coupled to the second terminal of the first capacitor, wherein the pixel driving unit is configured to providing a driving current according to a first reference voltage and the voltage on the second terminal of the first capacitor;

a resetting unit electrically coupled to the pixel driving unit, wherein the resetting unit is configured to reset the voltage on the second terminal of the first capacitor according to a third scanning signal and a second reference voltage;

a light-emitting diode electrically couple to the pixel driving unit for receiving a third reference voltage and the driving current;

a light-emitting activation unit electrically coupled between the light-emitting diode and the pixel driving unit, wherein the light-emitting activation is configured to provide the driving current to the light-emitting diode according to a light-emitting signal; and a coupling unit, wherein the coupling unit is electrically coupled to the light-emitting activation unit, the first terminal of the first capacitor, the input unit and the compensation unit.

3. The pixel structure of claim 2, wherein the input unit comprises a first transistor, and the pixel driving unit comprises a second transistor, and the second transistor has a first terminal for receiving the first reference voltage, a gate terminal electrically coupled to the second terminal of the first capacitor, and a second terminal for outputting the driving current.

4. The pixel structure of claim 2, wherein the compensation unit comprises a third transistor, and the third transistor has a first terminal electrically coupled to the pixel driving unit and the light-emitting activation unit, a gate terminal for receiving the second scanning signal, and a second terminal electrically coupled to the first capacitor and the pixel driving unit.

5. The pixel structure of claim 2, wherein the resetting unit comprises a fourth transistor, and the fourth transistor has a first terminal electrically coupled to the compensation unit, the first capacitor and the pixel driving unit, a gate terminal for receiving the third scanning signal, and a second terminal for receiving the second reference voltage.

6. The pixel structure of claim 2, wherein the compensation unit comprises a fifth transistor, and the fifth transistor has a first terminal for receiving the first reference voltage, a gate terminal for receiving the second scanning signal, and a second terminal electrically coupled to the input unit, the first capacitor and the coupling unit.

7. The pixel structure of claim 2, wherein the light-emitting activation unit comprises a sixth transistor, and the sixth transistor has a first terminal electrically coupled to the pixel driving unit, a gate terminal for receiving the light-emitting signal, and a second terminal electrically coupled to the light-emitting diode.

8. The pixel structure of claim 7, wherein the input unit comprises a first transistor, and the first transistor has a first terminal for receiving the data signal, a gate terminal for receiving the first scanning signal, and a second terminal electrically coupled to the compensation unit, the first capacitor and the coupling unit.

9. The pixel structure of claim 7, wherein the coupling unit comprises a second capacitor, and the second capacitor has a first terminal electrically coupled to the first terminal of the first capacitor, the compensation unit and the input unit, and a second terminal for receiving the light-emitting signal.

10. The pixel structure of claim 9, wherein the coupling unit is further configured to exclude interference of a parasitic capacitance on the first terminal of the first capacitor.

11. The pixel structure of claim 2, wherein the input unit comprises a first transistor, and the first transistor has a first terminal for receiving the data signal, a gate terminal for receiving the first scanning signal, and a second terminal electrically coupled to the compensation unit, the first capacitor and the coupling unit.

12. The pixel structure of claim 2, wherein the coupling unit comprises a second capacitor, and the second capacitor has a first terminal electrically coupled to the first terminal of the first capacitor, the compensation unit and the input unit, and a second terminal for receiving the light-emitting signal.

13. The pixel structure of claim 12, wherein the coupling unit is further configured to exclude interference of a parasitic capacitance on the first terminal of the first capacitor.

14. A driving method, suitable for driving the pixel structure of claim 2, wherein the driving method comprises:

in a first period, driving the resetting unit through the third scanning signal to reset the voltage on the second terminal of the first capacitor through the second reference voltage;

in a second period after the first period, driving the compensation unit through the second scanning signal to control the voltage on the first terminal of the first capacitor through the first reference voltage, and driving the compensation unit through the second scanning signal to control the voltage on the second terminal of the first capacitor through the first reference voltage to perform a threshold voltage compensation operation for the pixel driving unit;

in a third period after the second period, controlling the voltage on the first terminal of the first capacitor through the data signal and controlling the voltage on the second terminal of the first capacitor by coupling through the first capacitor, and driving the pixel driving unit through the voltage on the second terminal of the first capacitor to provide the driving current through the first reference voltage; and in a fourth period after the third period, stabilizing the voltage on the first terminal of the first capacitor and avoiding a floating voltage, and driving the light-emitting activation unit through the light-emitting signal to feed the driving current into the light-emitting diode.

15. The driving method of claim 14, wherein in the first period, the driving method further comprises:

providing the first scanning signal with a first level to the input unit;

providing the second scanning signal with the first level to the compensation unit;

providing the third scanning signal with a second level to the resetting unit, wherein the second level is different from the first level; and providing the light-emitting signal with the first level to the light-emitting activation unit.

16. The driving method of claim 15, wherein in the first period, the driving method further comprises switching the third scanning signal from the second level to the first level to disable a resetting operation of the resetting unit; and in the second period, the driving method further comprises switching the second scanning signal from the first level to the second level.

17. The driving method of claim 16, wherein in the second period, the driving method further comprises switching the second scanning signal from the second level to the first level to disable a threshold voltage compensation operation of the compensation unit; and in the third period, the driving method further comprises switching the first scanning signal from the first level to the second level.

18. The driving method of claim 17, wherein in the third period, before the first scanning signal is switched from the second level to the first level, the driving method further comprises:

switching the light-emitting signal from the first level to the second level.

19. The driving method of claim 18, wherein in the third period, the driving method further comprises switching the first scanning signal from the second level to the first level to disable an input operation of the input unit; and in the fourth period, the driving method further comprises setting the light-emitting signal as the second level.

20. The driving method of claim 19, wherein duration of the second period is roughly N times of a line scanning time, and N is a positive integer more than 2.

* * * * *